US007393498B2

(12) United States Patent
Skoglund et al.

(10) Patent No.: US 7,393,498 B2
(45) Date of Patent: Jul. 1, 2008

(54) SINTERED METAL PARTS AND METHOD FOR THE MANUFACTURING THEREOF

(75) Inventors: Paul Skoglund, Lerberget (SE); Mikhail Kejzelman, Malmo (SE); Senad Dizdar, Hoganas (SE)

(73) Assignee: Hoganas AB (SE)

( * ) Notice: Subject to any disclaimer, the term of this patent is extended or adjusted under 35 U.S.C. 154(b) by 36 days.

(21) Appl. No.: 11/110,945

(22) Filed: Apr. 21, 2005

(65) Prior Publication Data

US 2005/0244295 A1 Nov. 3, 2005

(30) Foreign Application Priority Data

Apr. 21, 2004 (SE) ..... 0401041

(51) Int. Cl.
*B22F 3/12* (2006.01)
*B22F 5/08* (2006.01)

(52) U.S. Cl. ..... 419/23; 419/28; 419/29; 419/38; 419/39

(58) Field of Classification Search ..... 419/28, 419/29, 38, 39, 23
See application file for complete search history.

(56) References Cited

U.S. PATENT DOCUMENTS

| | | | | |
|---|---|---|---|---|
| 5,288,556 | A * | 2/1994 | Lemelson | 428/408 |
| 5,540,883 | A | 7/1996 | Jones et al. | |
| 5,552,109 | A | 9/1996 | Shivanath et al. | |
| 5,613,180 | A | 3/1997 | Kosco | |
| 5,711,187 | A | 1/1998 | Cole et al. | |
| 5,729,822 | A | 3/1998 | Shivanath et al. | |
| 5,754,937 | A | 5/1998 | Jones et al. | |
| 6,171,546 | B1 * | 1/2001 | Mars et al. | 419/38 |
| 6,315,646 | B1 * | 11/2001 | Hohashita | 451/65 |
| 6,537,489 | B2 * | 3/2003 | Allroth et al. | 419/38 |
| 2004/0123696 | A1 * | 7/2004 | Kejzelman et al. | 75/231 |
| 2004/0123697 | A1 * | 7/2004 | Kejzelman et al. | 75/243 |
| 2004/0177719 | A1 | 9/2004 | Kosco | |
| 2005/0238523 | A1 | 10/2005 | Skoglund et al. | |

FOREIGN PATENT DOCUMENTS

| | | | |
|---|---|---|---|
| JP | 03 130349 | A | 6/1991 |
| WO | 1994/14557 | | 7/1994 |
| WO | 2004/037467 | A1 | 5/2004 |
| WO | 2005/102565 | A1 | 11/2005 |

OTHER PUBLICATIONS

Takeya, Y. et al., "Surface Rolling of Sintered Gears", SAE Technical Paper Series 820234, pp. 1-8, International Congress and Exposition, Detroit, Michigan, Feb. 22-26, 1982.

Sonsino, C.M. et al., "How to Improve the Fatigue Properties of Sintered Steels by Combined Mechanical and Thermal Surface Treatments", Modern Developments in Powder Metallurgy, vol. 16, pp. 33-48, International PM Conference, Toronto, Canada, Jun. 17-22, 1984.

Broszeit, E. et al., "Surface Rolling of Sintered Materials", Horizon and Powder Metallurgy Part I, pp. 403-406, Proceedings of the 1986 International Powder Metallurgy Conference and Exhibition Dousseldorf, Jul. 7-11, 1986.

Lipp, Klaus et al., "Design for Rolling Contact Fatigue", International Journal of Powder Metallurgy, vol. 39, No. 1, pp. 33-46, 2003.

International Preliminary Report on Patentability dated Nov. 14, 2006 for PCT/US2005/016594.

* cited by examiner

*Primary Examiner*—Roy King
*Assistant Examiner*—Ngoclan T. Mai
(74) *Attorney, Agent, or Firm*—Buchanan Ingersoll & Rooney, P.C.

(57) ABSTRACT

A powder metal tooth part and a method of producing a toothed sintered metal part by uniaxially compacting an iron or iron-based powder having coarse particles in a single compaction step, subjecting the part to sintering, and subjecting the part to a surface densifying process.

20 Claims, 1 Drawing Sheet

SINTERED METAL PARTS AND METHOD FOR THE MANUFACTURING THEREOF

FIELD OF THE INVENTION

The invention relates to powder metal parts. Specifically the invention concerns sintered metal parts, which have a densified surface and which are suitable for demanding applications. The invention also includes a method of preparing these metal parts.

BACKGROUND OF THE INVENTION

There are several advantages by using powder metallurgical methods for producing structural parts compared with conventional matching processes of fully dense steel. Thus the energy consumption is much lower and the material utilisation is much higher. Another important factor in favour of the powder metallurgical route is that components with net shape or near net shape can be produced directly after the sintering process without costly shaping such as turning, milling boring or grinding. However, normally a full dense steel material has superior mechanical properties compared with powder metallurgy (PM) components. Therefore, the goal has been to increase the density of PM components in order to reach values as close as possible to the density value of fully dense steel. At relatively high sintered densities the occurrence of porosity in a powder metallurgical body has mainly negatively influence of the dynamic mechanical properties, the fatigue properties. Additives and processing routes giving small pore sizes and round pores in the sintered body may diminish the negative effects of the porosity.

One area of future growth in the utilization of powder metal parts is in the automotive industry. Of special interest within this field is the use of powder metal parts in more demanding applications, such as power transmission applications, for example, gear wheels. Presently the most commonly used material for producing gear wheels for demanding automotive applications are based on wrought steel of the type 16MnCr5, 15CrNi6, or SAE 8620.

Problems with gear wheels formed by the powder metal process are that powder metal gear wheels have reduced bending fatigue strength in the tooth root region of the gear wheel, and low contact fatigue strength on the tooth flank compared with gears machined from bar stock or forgings. These problems may be reduced by plastic deformation of the surface of the tooth root and flank region through a process commonly known as surface densification. Products which can be used for these demanding applications are described, for example, in U.S. Pat. Nos. 5,711,187, 5,540,883, 5,552,109, 5,729,822, 6,171,546 and U.S. Patent Application Publication US 2004/0177719.

The U.S. Pat. No. 5,711,187 (1990) is particularly concerned with the degree of surface hardness, which is necessary in order to produce gear wheels, which are sufficiently wear resistant for use in heavy-duty applications. According to this patent the surface hardness or densification should be in the range of 90 to 100 percent of full theoretical density to a depth of at least 380 microns and up to 1,000 microns. No specific details are disclosed concerning the production process but it is stated that admixed powders are preferred as they have the advantage of being more compressible, enabling higher densities to be reached at the compaction stage. Furthermore it is stated that the admixed powders should include in addition to iron and 0.2% by weight of graphite, 0.5% by weight of molybdenum, chromium and manganese, respectively.

A method similar to that described in the U.S. Pat. No. 5,711,187 is disclosed in U.S. Pat. No. 5,540,883 (1994). According to the U.S. Pat. No. 5,540,883, bearing surfaces from powder metal blanks are produced by blending carbon and ferro alloys and lubricant with compressible elemental iron powder, pressing the blending mixture to form the powder metal blank, high temperature sintering the blank in a reducing atmosphere, compressing the powder metal blanks so as to produce a densified layer having a bearing surface, and then heat treating the densified layer. The sintered powder metal article should have a composition, by weight percent, of 0.5 to 2.0% chromium, 0 and 1.0% molybdenum, 0.1 and 0.6% carbon, with a balance of iron and trace impurities. Broad ranges as regards compaction pressures are mentioned. Thus it is stated that the compaction may be performed at pressures between 25 and 50 ton per square inch (about 390-770 MPa).

The U.S. Pat. No. 5,552,109 (1995) concerns a process of forming a sintered article having high density. The patent is particularly concerned with the production of connecting rods. As in the U.S. Pat. No. 5,711,187, no specific details concerning the production process are disclosed in the U.S. Pat. No. 5,552,109, but it is stated that the powder should be a pre-alloyed iron based powder, that the compacting should be performed in a single step, that the compaction pressures may vary between 25 and 50 ton per square inch (390-770 MPa) to green densities between 6.8 and 7.1 g/cm$^3$ and that the that the sintering should be performed at high temperature, particularly between 1270 and 1350° C. It is stated that sintered products having a density greater than 7.4 g/cm$^3$ are obtained and it is thus obvious that the high sintered density is a result of the high temperature sintering.

In U.S. Pat. No. 5,729,822 (1996), a powder metal gear wheel having a core density of at least 7.3 g/cm$^3$ and a hardened carburized surface is disclosed. The powders recommended are the same as in the U.S. Pat. Nos. 5,711,187 and 5,540,883, which discuss mixtures obtained by blending carbon, ferro alloys and lubricant with compressible powder of elemental iron. In order to obtain high sintered core density the patent mentions warm pressing; double pressing, double sintering; high density forming as disclosed in the U.S. Pat. No. 5,754,937; the use of die wall lubrication, instead of admixed lubricants during powder compaction; and rotary forming after sintering. Compacting pressures of around 40 tons per square inch (620 MPa) are typically employed.

Also the U.S. Pat. No. 6,171,546 discloses a method for obtaining a densified surface. According to this patent the surface densification is obtained by rolling or, preferably, by shot peening of a green body of an iron-based powder. From this patent it can be concluded that the most interesting results are obtained if a pre-sintering step is performed before the final densification and sintering operations. According to this patent the sintering can be performed at 1120° C., i.e. at conventional sintering temperatures, but as two sintering steps are recommended the energy consumption will be quite considerable.

The U.S. Patent Application Publication US 2004/0177719 describes a method of forming powder metal materials and parts, such as gears and sprockets, having surface regions that are uniformly densified to full density to depth ranging from 0.001 inches to 0.040 inches, and core regions that can have at least 92 percent theoretical density and further can have essentially full density, i.e., 98% and above.

The surface densification of sintered PM steels is discussed in, e.g., the Technical Paper Series 8202 234, (International Congress & Exposition, Detroit, Mich., Feb. 22-26, 1982). In this paper a study of surface rolling of sintered gears is reported. Fe—Cu—C and Ni—Mo alloyed materials were used for the study. The paper reveals the results from basic research on the surface rolling of sintered parts and the application of it to sintered gears. The basic studies includes surface rolling with different diameters of the rolls, best results in terms of strength were achieved with smaller roll diameter, lesser reduction per pass and large total reduction. As an example for a Fe—Cu—C material a densification of 90% of theoretical density was achieved with a roll of 30 mm diameter to a depth of 1.1 mm. The same level of densification was achieved to a depth of about 0.65 mm for a 7.5 mm diameter roll. The small diameter roll however was able to increase the densification to about full density at the surface whereas the large diameter roll increased the density to about 96% at the surface. The surface rolling technique was applied to sintered oil-pumps gears and sintered crankshaft gears. In an article in Modern Developments in Powder Metallurgy, Volume 16, p 33-48 1984 (from the International PM Conference, Jun. 17-22,1984 Toronto Canada), the authors have investigated the influence of shot-peening, carbonitriding and combinations thereof on the endurance limit of sintered Fe+1.5% Cu and Fe+2% Cu+2.5% Ni alloys. The densities reported of these alloys were 7.1 and 7.4 g/cm$^3$. Both a theoretical evaluation of the surface rolling process and a bending fatigue testing of surface rolled parts is published in an article in Horizon of Powder Metallurgy part 1, p. 403-406, Proceedings of the 1986 (International Powder Metallurgy Conference and Exhibition DOusseldorf, 7-11 Jul. 1986).

According to the prior art above many different routes have been suggested in order to reach a high sintered density of a powder metallurgical component. However the suggested processes all includes steps adding additional costs such as warm compaction, double pressing-double sintering, die wall lubrication, high temperature sintering etc. Furthermore, for high load applications such as gear wheels, dynamic mechanical properties such as bending fatigue strength and contact fatigue strength needs to reach the same level as gear wheels produced from full dense steel. A simple and cost effective method for the preparation of gear wheels and similar products having dynamic mechanical properties equal to wrought gear wheels, would thus be attractive.

SUMMARY

In brief it has now been found that powder metal parts in more demanding applications, such as power transmission applications, for example, gear wheels, having the same dynamic mechanical properties as similar gear wheels produced from wrought steel, machined bar stocks or forgings, can be obtained by subjecting a coarse iron or iron-based powder to uniaxial compaction at a pressure above 700 MPa to a density above 7.35 g/cm$^3$, sintering the obtained green product and subjecting the sintered product to a surface densification process followed by heat treatment such as case hardening, optionally followed by a step of shot peening. Specifically the invention concerns a sintered metal part which has a densified surface and a core density of at least 7.35 g/cm$^3$ obtained by single pressing, without applying die wall lubrication, to at least 7.35 g/cm$^3$ and single sintering followed by heat treatment of an iron-based powder mixture having coarse iron or iron-based powder particles as well as the method of producing such metal parts.

The density levels above concerns products based on pure or low-alloyed iron powder.

DETAILED DESCRIPTION

Powder Types

Figure 1:
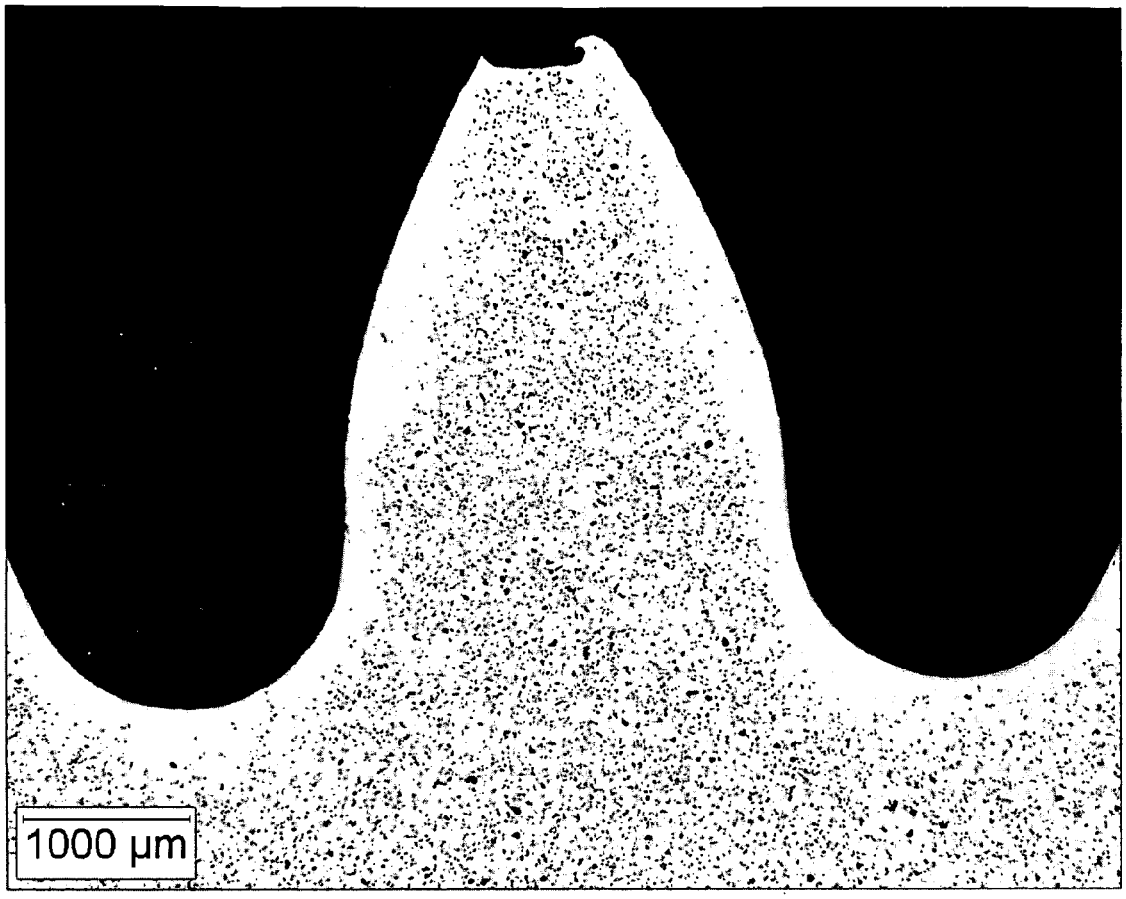
FIG. 1 is a light optical micrograph of a cross section of a surface densified gear wheel according to the invention.

Suitable metal powders which can be used as starting materials for the compaction process are powders prepared from metals such as iron. Alloying elements such as carbon, chromium, manganese, molybdenum, copper, nickel, phosphorous, sulphur etc. can be added as particles, such as pre-alloyed or diffusion alloyed particles, in order to modify the properties of the final sintering product. The iron-based powders can be selected from the group including substantially pure iron powders, pre-alloyed iron-based particles, diffusion alloyed iron-based iron particles, and/or mixtures of iron particles or iron-based particles and alloying elements. As regards the particle shape, it is preferred that the particles have an irregular form as is obtained by water atomisation. Also, sponge iron powders having irregularly shaped particles may be of interest.

As regards PM parts for high demanding applications, especially promising results have been obtained with pre alloyed water atomised powders including low amounts of one or more of the alloying elements, such as Mo, Cr and Mn. Examples of such powders are powders having a chemical composition corresponding to the chemical composition of Astaloy Mo (1.5% Mo and Astaloy 85 Mo (0.85% Mo)), as well as Astaloy CrM and Astaloy CrL (1.5 Cr, 0.2 Mo, and 0.11% Mn) from Höganäs AB, Sweden.

Exemplary embodiments include the use of powders with coarse particles (i.e., powder essentially without fine particles). The term "essentially without fine particles" is intended to mean that less than about 10% of the powder particles have a size below 45 μm as measured by the method described in SS-EN 24 497. In an exemplary embodiment, an average particle diameter can be between 75 and 300 μm. Additionally, in an exemplary embodiment, the amount of particles above 212 μm can be above 20% with a maximum particle size that can be about 2 mm.

The size of the iron-based particles normally used within the PM industry is distributed according to a Gaussian distribution curve with an average particle diameter in the region of 30 to 100 μm and about 10-30% less than 45 μm. Thus the powders used according to exemplary embodiments have a particle size distribution deviating from that normally used. These powders can be obtained by removing the finer fractions of the powder or by manufacturing a powder having the desired particle size distribution.

Thus for the powders mentioned above in exemplary embodiments, for example, a particle size distribution for a powder having a chemical composition corresponding to Astaloy 85 Mo can include at most 5% of the particles with a diameter of less than 45 μm and an average particle diameter of between 106 and 300 μm. Additionally, exemplary embodiments for corresponding values for a powder having a chemical composition corresponding to Astaloy CrL, for example, can include less than 5% of particles with a diameter of less than 45 μm and an average particle diameter of between 106 and 212 μm.

In order to obtain compacts having satisfactory mechanical sintered properties of the sintered part according to exemplary embodiment, graphite can be added to the powder mixture to be compacted. Thus, graphite in amounts between about 0.1 to about 1.0, between about 0.2 to about 1.0 and/or between about 0.2 to about 0.8% by weight of the total mixture to be compacted can be added before compaction to tailor the mechanical sintered properties of a sintered part.

The iron-base powder can also be combined with a lubricant before it is transferred to the die (internal lubrication). A lubricant can added in order to reduce friction between the metal powder particles and/or between metal powder particles and a die during a compaction, or a pressing step. Examples of suitable lubricants are e.g. stearates, waxes, fatty acids and derivatives thereof, oligomers, polymers and/or other organic substances with lubricating effect. The lubricants can be added in the form of particles, but can also be bonded and/or coated to the metal particles. A preferred lubricating substance is disclosed in patent application WO 2004/037467 A1, which is hereby incorporated by reference in its entirety. According to an exemplary embodiment, the lubricant can be added to the iron-based powder in amounts between about 0.05 and about 0.6%, and/or between about 0.1 and about 0.5% by weight of the mixture.

As optional additives hard phases, binding agents, machinability enhancing agents and flow enhancing agents may be added.

Compaction

Conventional compaction at high pressures, i.e. pressures above about 600 MPa with conventionally used powders including finer particles, in admixture with low amounts of lubricants (less than 0.6% by weight) are generally considered unsuitable due to the difficulties to eject the parts after compaction without damaging the surfaces of the parts. By using the powders according to exemplary embodiments, it has unexpectedly been found that the ejection force can be reduced at high pressures and that components having acceptable or even perfect surfaces may be obtained also when die wall lubrication is not used.

The compaction may be performed with standard equipment, which means that the new method may be performed without expensive investments. The compaction is performed uniaxially in a single step at ambient or elevated temperature. In exemplary embodiments, compaction pressures above about 700, above 800 and/or above 900 or even 1000 MPa can be used, wherein the compaction should preferably be performed to densities above 7.45 g/cm$^3$.

Sintering

Any conventional sintering furnace may be used and the sintering times may vary between about 15 and 60 minutes. The atmosphere of the sintering furnace may be an endogas atmosphere, a mixture between hydrogen and nitrogen or in vacuum. The sintering temperatures may vary between 1100° C. and 1350° C. Preferably the sintering temperature is between 1200° C. and 1350° C.

In comparison with methods involving double pressing and double sintering the method according to exemplary embodiments have the advantage that one pressing step and one sintering step can be eliminated.

Structure

A distinguishing feature of the core of the high density green and sintered metal part is the presence of large pores. Normally, large pores are regarded as a drawback and different measures are taken in order to make the pores smaller and rounder. It has now surprisingly been that sintered powder metal parts such as gear wheels, sprockets or other toothed metal components having dynamic mechanical properties equal to the properties of toothed components produced from wrought steel can be produced. As high sintered density can be reached in a single pressing, single sintering process by using a metal powder having a coarse grain size distribution, costly processes, such as double pressing-double sintering, warm compaction, high temperature sintering etc., for reaching high sintered density can be avoided. Thus by utilising the method according to exemplary embodiments, production of for example gear wheels subjected to high loads, having excellent mechanical properties can be facilitated to a large extent.

Surface Densification

The surface densification step may be performed by rolling, shot peening, laser peening, sizing, extrusion etc. Exemplary methods are radial rolling or shot peening combined with burnishing. The powder metal parts will obtain better mechanical properties with increasing densifying depth.

Heat Treatment

After the surface densification process the toothed part is preferably subjected to a heat treatment process such as those commonly used in commercial production of gear wheels, examples of heat treatment process are case hardening, nitriding, carbo-nitriding, induction hardening, nitro-carburizing or through hardening.

The increased surface hardness achieved by the heat treatment process may be further enhanced by coating the surface of the toothed component with a wear resistant and/or lubricating layer.

EXAMPLES

Example 1

For testing of gear tooth bending fatigue strength, gear wheels having 18 teeth a modules of 1.5875 mm a face width of 10 mm and a bore diameter of 15 mm were produced by uniaxial compaction of an iron-based powder metallurgical composition at a compaction pressure of 950 MPa. The gear wheels were subjected to sintering at a temperature of 1280° C. for 30 minutes in an atmosphere of 90% nitrogen, 10% of hydrogen followed by different processing according to table 3. The sintered density was 7.55 g/cm$^3$. The base material of the iron-based powder metallurgical composition was mixed with 0.2% of a lubricating substance according to WO 2004/037467 A1 and graphite before compaction.

As base material a powder, Fe-1.5Cr-0.2Mo, having a chemical composition corresponding to Astaloy CrL, an atomised Mo—, Cr— prealloyed iron based powder with a Cr content of 1.35-1.65%, a Mo content of 0.17-0.27%, a carbon content of at most 0.010% and an oxygen content of at most 0.25%, and having a coarse particle size distribution according to table 1 was used.

TABLE 1

| Particle size μm | % by weight |
|---|---|
| >500 | 0 |
| 425-500 | 0.2 |
| 300-425 | 7.4 |
| 212-300 | 21.9 |
| 150-212 | 225.1 |
| 106-150 | 23.4 |
| 75-106 | 11.2 |
| 45-75 | 7.1 |
| <45 | 3.7 |

As reference material gear wheels produced from wrought steel of 16MnCr5 and 15CrNi6 type were used.

TABLE 3 secondary operations of gear wheel for testing of bending fatigue strength of the tooth root.

| Gear wheel no | | Material | Secondary operation |
|---|---|---|---|
| 1 | Reference | 16MnCr5 | Case hardening |
| 2 | Reference | 15CrNi6 | Case hardening |
| 3 | PM | Fe1.5Cr0.2Mo + 0.2% C | Case hardening |
| 4 | PM | Fe1.5Cr0.2Mo + 0.2% C | Shot peening + Burnishing + Case hardening |
| 5 | PM | Fe1.5Cr0.2Mo + 0.2% C | Shot peening + Burnishing + Case hardening + Shot peening |
| 6 | PM | Fe1.5Cr0.2Mo + 0.2% C | Surface rolling + Case hardening |
| 7 | PM | Fe1.5Cr0.2Mo + 0.2% C | Surface rolling + Case hardening + Shot peening |

The case hardening was performed at 920° C. at a carbon potential of 0.8, quenched in oil at 60° C. followed by tempering 200° C. for 20 minutes.

Shot peening was performed at an Almen intensity of 0.3 mmA.

Surface rolling was performed as radial rolling in a surface rolling equipment having two rolling tools.

The following table 4 shows the results.

TABLE 4

| Gear wheel no | | Material | Secondary operation | Bending fatigue strength (MPa) |
|---|---|---|---|---|
| 1 | Ref wrought steel | 16MnCr5 | Case hardening | 1400 |
| 2 | Ref wrought steel | 15CrNi6 | Case hardening | 1250 |
| 3 | Test PM steel | Fe1.5Cr0.2Mo + 0.2% C | Case hardening | 800 |
| 4 | Test PM steel | Fe1.5Cr0.2Mo + 0.2% C | Shot peening + Burnishing + Case hardening | (1150 preliminary) |
| 5 | Test PM steel | Fe1.5Cr0.2Mo + 0.2% C | Shot peening + Burnishing + Case hardening + Shot peening | 1300 |
| 6 | Test PM steel | Fe1.5Cr0.2Mo + 0.2% C | Surface rolling + Case hardening | 1150 |
| 7 | Test PM steel | Fe1.5Cr0.2Mo + 0.2% C | Surface rolling + Case hardening + Shot peening | (1300 preliminary) |

Example 2

For rolling contact fatigue test rolls having an outer diameter of 30 mm, inner diameter of 12 mm and height of 15 mm and a test surface of 5 mm were produced. The test material, based on Fe1.5Cr0.2Mo, as used in example 1, were compacted at a compaction pressure of 950 MPa to a green density of 7.52 g/cm$^3$ followed by sintering at 1280° C. for 30 minutes in an atmosphere of 90% nitrogen, 10% of hydrogen. The sintered density was 7.55 g/cm$^3$. As reference material rolls having the same dimensions produced from wrought steel, SAE 8620 was used. Before testing the samples were subjected to a secondary operation according to table 5. The testing was performed according to the method described by K. Lipp and G. Hoffmann, in the article "Design for rolling contact fatigue", published in International Journal of Powder Metallurgy. Vol. 39/No. 1 (2003), pp. 33-46.

The following table 5 shows the results.

TABLE 5

| Gear wheel no | | Material | Secondary operation | Roll contact fatigue strength (MPa) |
|---|---|---|---|---|
| 1 | Ref wrought steel | SAE 8620 | Case hardening | (2150 preliminary) |
| 2 | Test PM steel | Fe1.5Cr0.2Mo + 0.2% C | Surface rolling + Case hardening | (2100 preliminary) |
| 3 | Test PM steel | Fe1.5Cr0.2Mo + 0.2% C | Shot peening + Burnishing + Case hardening | (2100 preliminary) |

As can be seen from the results according to table 4 and 5 the gear wheel produced according to the invention show bending fatigue strength and roll contact fatigue strength at the same level as similar gear wheels produced from full dense wrought steel.

The invention claimed is:

1. A method of producing a toothed sintered metal part having a fatigue strength close to the fatigue strength of said toothed metal part produced from wrought steel or machined from bar stock or forgings comprising the steps of:

a) uniaxially compacting an iron or iron-based powder having coarse particles to a density above 7.35 g/cm$^3$ in a single compaction step at a compaction pressure of at least 700 MPa, wherein less than 10% of the iron-based powder has a particle size less than 45 μm;

b) subjecting the part to sintering in a single step at a temperature of at least 1100° C. to a density of at least 7.35 g/cm$^3$;

c) subjecting the part to a surface densifying process; and d) subjecting the part to a surface finish improving process.

2. The method according to claim 1, wherein the powder includes up to 1% graphite and is compacted in a non-lubricated die and ejected with an undamaged part surface.

3. The method according to claim 2, wherein the powder includes alloying additives selected from the group consisting of chromium, molybdenum, manganese, nickel and copper.

4. The method according to claim 3, wherein the alloying elements are prealloyed to the iron-based powder.

5. The method according to claim 1, wherein the powder includes a lubricating substance.

6. The method according to claim 5, wherein the lubricating substance is added in an amount between about 0.05 and about 0.6%, the powder has an average particle size between 75 and 300 μm and is compacted in a non-lubricated die and ejected with an undamaged part surface.

7. The method according to claim 1, wherein less than 5% of the iron based powder has a particle size less than 45 μm.

8. The method according to claim 2, wherein the compaction is performed at a pressure of above 800 MPa.

9. The method according to claim 2, wherein the sintering is performed at a temperature of above 1200° C.

10. The method according to claim 1, wherein the surface densifying process is performed by rolling.

11. The method according to claim 1, wherein the surface densifying process is performed by shot peening or laser peening.

12. The method according to claim 1, wherein the surface finish improving process is one of burnishing, grinding, polishing or electro-polishing.

13. The method according to claim 10, wherein the part is heat treated.

14. The method according to claim 13, wherein the heat treatment is one of case hardening, nitriding, carbo-nitriding, nitro-carburising, induction hardening or through hardening.

15. The method according to claim 14, wherein after the heat treatment the part is coated with a wear resistant and/or lubricating layer.

16. The method according to claim 14, wherein after the heat treatment the part further is subjected to shot peening.

17. The method according to claim 5, wherein the lubricating substance is added in an amount between about 0.1 and about 0.4%, the iron-based powder has an average particle size between 75 and 300 μm and is compacted in a non-lubricated die and ejected with an undamaged part surface.

18. The method according to claim 2, wherein the compaction is performed at a pressure of above 900 MPa and the sintering is performed at a temperature of above 1250° C.

19. The method according to claim 1, wherein the iron-based powder is a pre-alloyed powder.

20. A method of producing a toothed sintered metal part having a fatigue strength close to the fatigue strength of said toothed metal part produced from wrought steel or machined from bar stock or forgings comprising the steps of:

a) uniaxially compacting an iron or iron-based powder having coarse particles to a density above 7.35 g/cm$^3$ in a single compaction step at a compaction pressure of at least 700 MPa, wherein less than 10% of the mn-based powder has a particle size less than 45 μm;

b) subjecting the part to sintering in a single step at a temperature of at least 1100° C. to a density of at least 7.35 g/cm$^3$;

c) subjecting the part to a surface densifying process;

d) subjecting the part to a heat treating process; and e) subjecting the part to shot peening.

* * * * *